US012344441B2

(12) United States Patent
Aslani

(10) Patent No.: US 12,344,441 B2
(45) Date of Patent: Jul. 1, 2025

(54) BOTTLE CAP FOR SQUEEZE BOTTLES

(71) Applicant: Ali Aslani, Tehran (IR)

(72) Inventor: Ali Aslani, Tehran (IR)

( * ) Notice: Subject to any disclaimer, the term of this patent is extended or adjusted under 35 U.S.C. 154(b) by 65 days.

(21) Appl. No.: 18/346,828

(22) Filed: Jul. 4, 2023

(65) Prior Publication Data

US 2024/0001481 A1 Jan. 4, 2024

Related U.S. Application Data

(63) Continuation-in-part of application No. PCT/IB2021/060785, filed on Nov. 21, 2021.

(60) Provisional application No. 63/133,430, filed on Jan. 4, 2021.

(51) Int. Cl.

| | |
|---|---|
| ***B65D 39/08*** | (2006.01) |
| ***B65D 39/00*** | (2006.01) |
| ***B65D 47/20*** | (2006.01) |
| *B65D 1/32* | (2006.01) |
| *B65D 41/62* | (2006.01) |

(52) U.S. Cl.

CPC ..... *B65D 39/08* (2013.01); *B65D 39/0052* (2013.01); *B65D 47/2056* (2013.01); *B65D 1/32* (2013.01); *B65D 41/62* (2013.01)

(58) Field of Classification Search

CPC ..... B65D 39/08; B65D 39/0052; B65D 47/2056; B65D 1/32; B65D 41/62; B65D 51/1672

See application file for complete search history.

(56) References Cited

U.S. PATENT DOCUMENTS

| | | | | |
|---|---|---|---|---|
| 2009/0283555 | A1* | 11/2009 | Maxwell | B65D 47/2031 222/494 |
| 2015/0328653 | A1* | 11/2015 | Minnette | B65D 1/32 222/213 |
| 2016/0244222 | A1* | 8/2016 | Sterling | B65D 47/122 |
| 2019/0047754 | A1* | 2/2019 | Dubiel | G01F 11/006 |
| 2020/0055644 | A1* | 2/2020 | Höhm | B05B 11/04 |
| 2023/0014631 | A1* | 1/2023 | Savage | B65D 83/0055 |

* cited by examiner

*Primary Examiner* — Shawn M Braden

(57) ABSTRACT

A bottle cap may include a threaded mounting section configured to be screwed to an outlet port of the squeeze bottle from a first end of the threaded mounting section, a spring-loaded nozzle attached to a second opposing end of the threaded mounting section, where the spring-loaded nozzle includes a nozzle and a first resilient spiral spring connecting the second end of the threaded mounting section to an outer surface of the nozzle. The bottle cap may further include a first spring-loaded plug mounted within the threaded mounting section between the opening of the squeeze bottle and the inlet port of the nozzle. The first spring-loaded plug may include a first plug attached to an inner surface of the threaded mounting section utilizing a second resilient spiral spring. The first plug is configured to sit on a peripheral ledge of the inlet port of the nozzle.

14 Claims, 10 Drawing Sheets

BOTTLE CAP FOR SQUEEZE BOTTLES

CROSS-REFERENCE TO RELATED APPLICATION

This application is a continuation-in-part of International Application No. PCT/IB2021/060785, filed Nov. 21, 2021, and entitled "A BOTTLE CAP FOR SQUEEZE BOTTLES" which claims the benefit of priority from U.S. Provisional Patent Application Ser. No. 63/133,430, filed on Jan. 4, 2021, and entitled "INVERTED BOTTLE CAP WITH THE ABILITY TO AUTOMATICALLY ADJUST THE INTERNAL AIR PRESSURE," which are both incorporated herein by reference in their entirety.

TECHNICAL FIELD

The present disclosure relates to bottle caps and particularly to a closure assembly for liquid bottles and vessels. More particularly, the present disclosure relates to a leak-free bottle cap for squeeze bottles.

BACKGROUND

Various industries utilize squeeze bottles for packaging and dispensing liquid products, such as dishwashing liquids, detergents, and shampoos. In practice, a squeeze bottle is made of elastically deformable plastic and a user may easily invert a squeeze bottle and squeeze it to dispense its content. However, the liquid content of a squeeze bottle may adhere to inner surfaces of the squeeze bottle and consequently dispensing an entire volume of the liquid content may be challenging.

One way to address the above-mentioned problem of incomplete discharge of liquid content of a squeeze bottle is to design bottles that may be placed upside down on their caps. This way, when the bottle is not in use, the liquid content may always move toward an output nozzle of the bottle near the cap, due to the force of gravity. A user may then simply open the cap and since the content is already near the output nozzle, the liquid content may be dispensed easily with a slight squeeze. However, leakage is one major drawback of such upside down squeeze bottles. The liquid content of an upside down bottle may leak into an inner volume of the cap or may leak from the periphery of the cap. Either way, when a user picks up the bottle and opens the cap, the liquid content may leak out or pour out before the user may squeeze the bottle or hold the bottle where they want the contents to be dispensed onto.

There is, therefore, a need for bottle caps that may be designed to prevent such leaks in upside down squeeze bottles. There is further a need for developing leak-free bottle caps that not only prevent the leakage of the liquid contents when the bottle is upside down, but also may allow air to enter the squeeze bottle, after a user squeezes the bottle, to help quickly restore the bottle to its initial form.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description and the drawings.

According to one or more exemplary embodiments, the present disclosure is directed to a bottle cap for a squeeze bottle. An exemplary bottle cap may include a threaded mounting section that may be extended between a first end of an exemplary threaded mounting section and a second opposing end of an exemplary threaded mounting section. An exemplary threaded mounting section may be configured to be screwed to an outlet port of an exemplary squeeze bottle from an exemplary first end of an exemplary threaded mounting section.

An exemplary bottle cap may further include a spring-loaded nozzle that may be attached to an exemplary second end of an exemplary threaded mounting section. An exemplary spring-loaded nozzle may include a nozzle and a first resilient spiral spring. An exemplary nozzle may extend between an inlet port of an exemplary nozzle and an outlet port of an exemplary nozzle. An exemplary first resilient spiral spring may be configured to connect an exemplary second end of an exemplary threaded mounting section to an outer surface of an exemplary nozzle.

An exemplary bottle cap may further include a first spring-loaded plug that may be mounted within an exemplary threaded mounting section between an exemplary opening of an exemplary squeeze bottle and an exemplary inlet port of an exemplary nozzle. An exemplary first spring-loaded plug may include a first plug attached to an inner surface of an exemplary threaded mounting section utilizing a second resilient spiral spring. An exemplary first plug may be configured to sit on a peripheral ledge of an exemplary inlet port of an exemplary nozzle.

BRIEF DESCRIPTION OF THE DRAWINGS

The novel features which are believed to be characteristic of the present disclosure, as to its structure, organization, use and method of operation, together with further objectives and advantages thereof, will be better understood from the following drawings in which a presently exemplary embodiment of the present disclosure will now be illustrated by way of example. It is expressly understood, however, that the drawings are for illustration and description only and are not intended as a definition of the limits of the present disclosure. Embodiments of the present disclosure will now be described by way of example in association with the accompanying drawings in which.

DETAILED DESCRIPTION

The novel features which are believed to be characteristic of the present disclosure, as to its structure, organization, use and method of operation, together with further objectives and advantages thereof, will be better understood from the following discussion.

The present disclosure is directed to exemplary embodiments of a leak-free bottle cap. An exemplary leak-free bottle cap may be utilized to prevent leakages from squeeze bottle, especially, exemplary squeeze bottle that are stored upside-down. An exemplary leak-free bottle cap may include a dispensing assembly that may be configured for both allowing liquid discharge from an exemplary squeeze bottle responsive to a user exerting squeezing pressure to an exemplary squeeze bottle and allowing air to enter an exemplary squeeze bottle after the squeezing pressure is removed from an exemplary squeeze bottle. An exemplary dispensing assembly may only allow for discharge of liquid from an exemplary squeeze bottle when a user squeezes an exemplary squeeze bottle and when an exemplary squeeze bottle is not in use and is store upside-down, an exemplary dispensing assembly provides a liquid tight seal on an outlet port of an exemplary squeeze bottle.

An exemplary dispensing assembly may include a nozzle that may have an inlet port and an outlet port. In order to prevent leakages, an exemplary dispensing assembly may further include a spring-loaded plug that may contact an exemplary inlet port of an exemplary nozzle and a resilient spring attached to an exemplary nozzle that further maintains the position of an exemplary nozzle below an exemplary spring-loaded plug.

An exemplary leak-free bottle cap may further include a base assembly that may include a housing and a second spring-loaded plug. An exemplary housing may include a lower annular base that may allow for a stable upside-down mounting of an exemplary squeeze bottle on an exemplary base assembly. An exemplary second spring-loaded plug may be configured to be put in contact with an exemplary outlet port of an exemplary nozzle to seal an exemplary nozzle in order to prevent any possible leakage from an exemplary dispensing assembly.

Figure 1:
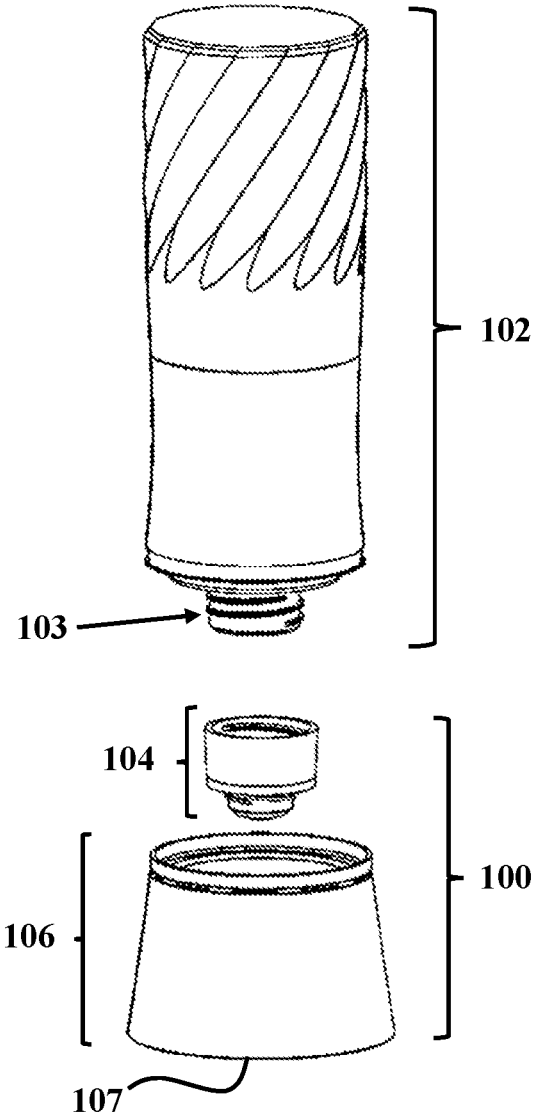
FIG. 1 illustrates an exploded perspective view of a leak-free cap mounted on a squeeze bottle, consistent with one or more exemplary embodiments of the present disclosure.

FIG. 1 illustrates an exploded perspective view of a leak-free cap 100 mounted on a squeeze bottle 102, consistent with one or more exemplary embodiments of the present disclosure. In an exemplary embodiment, squeeze bottle 102 may be a bottle for containing and dispensing viscous liquids, such as dishwashing liquids, detergents, liquid soaps, shampoos, and viscous food products. In an exemplary embodiment, squeeze bottle 102 may be made of an elastically deformable material, such as elastically deformable plastic. Consequently, in response to being squeezed by a user, squeeze bottle 102 may be inwardly deformed, exerting pressure on the contents of squeeze bottle 102 and thereby dispensing the contents. In an exemplary embodiment, since squeeze bottle 102 is made of an elastically deformable material, in response to removing the squeezing pressure, squeeze bottle 102 inherently restores to the original unsqueezed shape of squeeze bottle 102.

In an exemplary embodiment, squeeze bottle 102 may be stored upside-down to keep the viscous content of squeeze bottle 102 near an outlet port 103 of squeeze bottle 102 under the gravity force. In an exemplary embodiment, outlet port 103 may be an outlet port from which any materials or liquids within squeeze bottle 102 may be output. In an exemplary embodiment, such upside-down storage and placement of squeeze bottle 102 may address the problem of incomplete discharge of viscous contents of squeeze bottle 102. In an exemplary embodiment, leak-free cap 100 may be screwed to outlet port 103 of squeeze bottle 102. In an exemplary embodiment, leak-free cap 100 may be a normally-closed valve assembly to ensure that viscous contents of squeeze bottle 102 may only be dispensed from squeeze bottle 102 when a user squeezes squeeze bottle 102. In other words, leak-free cap 100 may prevent any leaks from squeeze bottle 102, should squeeze bottle 102 be inverted or placed upside-down. Furthermore, in an exemplary embodiment, leak-free cap 100 may allow for an easy upside-down storage and placement of squeeze bottle 102.

In an exemplary embodiment, leak-free cap 100 may include a dispensing assembly 104 and a base assembly 106. In an exemplary embodiment, dispensing assembly 104 may be configured to be fitted onto outlet port 103 of squeeze bottle 102 and prevent any possible leaks when squeeze bottle 102 is upside-down, that is, a size of dispensing assembly may allow it to fit onto outlet port 103 so that no gap is left, a seal is formed, and there are no possible leaks when squeeze bottle 102 is squeezed. In an exemplary embodiment, base assembly 106 may be configured to facilitate upside-down storage of squeeze bottle 102 by providing a base 107 upon which squeeze bottle 102 may rest upside-down.

Figure 2:
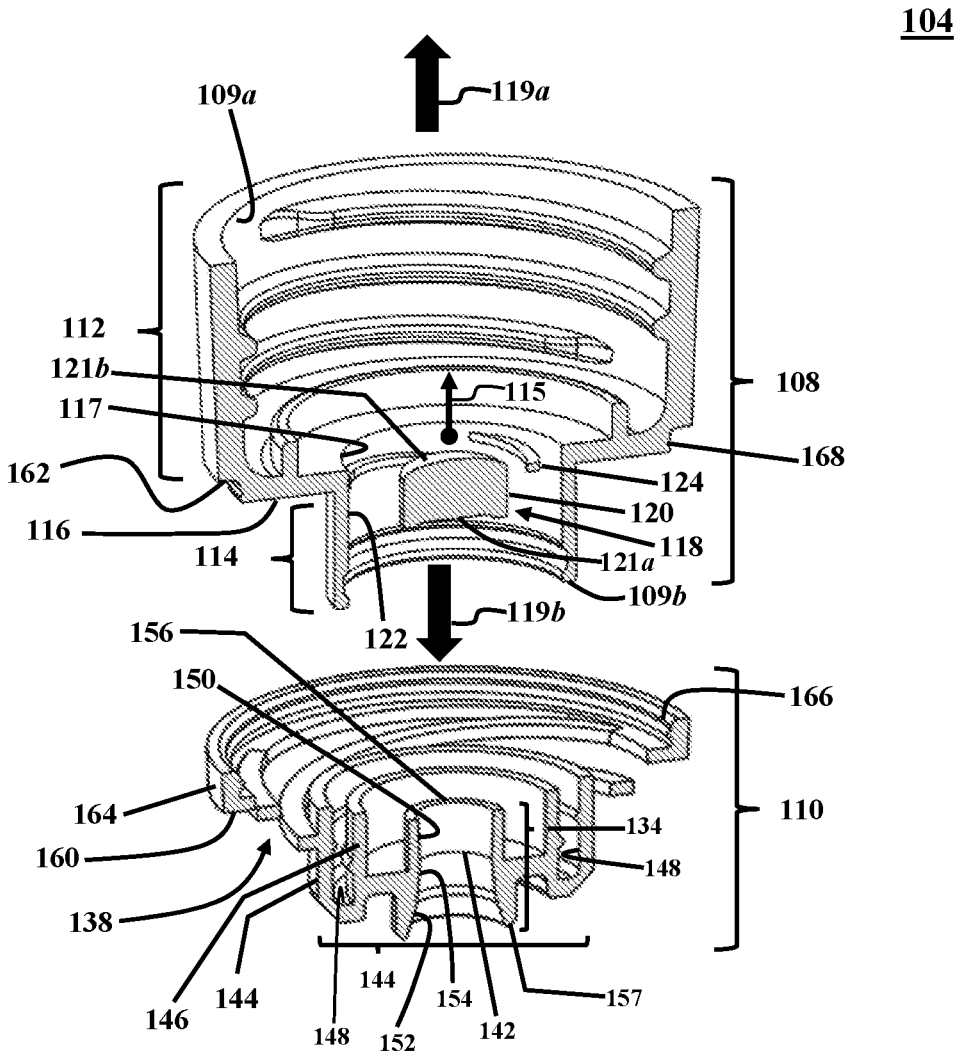
FIG. 2 illustrates an exploded sectional view of a dispensing assembly, consistent with one or more exemplary embodiments of the present disclosure.

FIG. 2 illustrates an exploded sectional view of dispensing assembly 104, consistent with one or more exemplary embodiments of the present disclosure. In an exemplary embodiment, dispensing assembly 104 may include a threaded mounting section 108 that may be attached to a spring-loaded nozzle 110. In an exemplary embodiment, threaded mounting section 108 may include a base disk 116 with a central hole 117 and an annular threaded wall 112 that may extend from an outer periphery of base disk 116 in a first direction along a normal axis 115 of base disk 116. As used herein, a normal axis of an object may refer to an axis perpendicular to the largest surface of that object. For example, normal axis 115 of base disk 116 is an axis perpendicular to a main plain of base disk 116. In an exemplary embodiment, annular threaded wall 112 may be configured to be screwed to outlet port 103 of squeeze bottle 102 from a first end 109*a* of annular threaded wall 112, that is, first end 109*a* of annular threaded wall 112 may be physically structured that first end 109*a* of annular threaded wall 112 corresponds to outlet port 103 of squeeze bottle 102.

In an exemplary embodiment, threaded mounting section 108 may further include an annular passage 114 that may extend from a periphery of central hole 117 in a second direction along normal axis 115 of base disk 116, where the second direction may be opposite the first direction. In an exemplary embodiment, the first direction is shown by arrow 119*a*, and the second direction is shown by arrow 119*b*. In an exemplary embodiment, base disk 116 may form a shoulder between annular threaded wall 112 and annular passage 114. In an exemplary embodiment, annular threaded wall 112 and annular passage 114 may coaxially extend in opposite directions, namely, the first direction (arrow 119*a*) and the second direction (arrow 119*b*). As used herein, annular threaded wall 112 and annular passage 114 being extended coaxially may refer to a longitudinal axis of annular threaded wall 112 being parallel and aligned with a longitudinal axis of annular passage 114. In an exemplary embodiment, the longitudinal axis of annular threaded wall 112 and the longitudinal axis of annular passage 114 may both be parallel with normal axis 115. As used herein, a longitudinal axis of an object is an axis associated with the largest dimension of that object.

Figure 3:
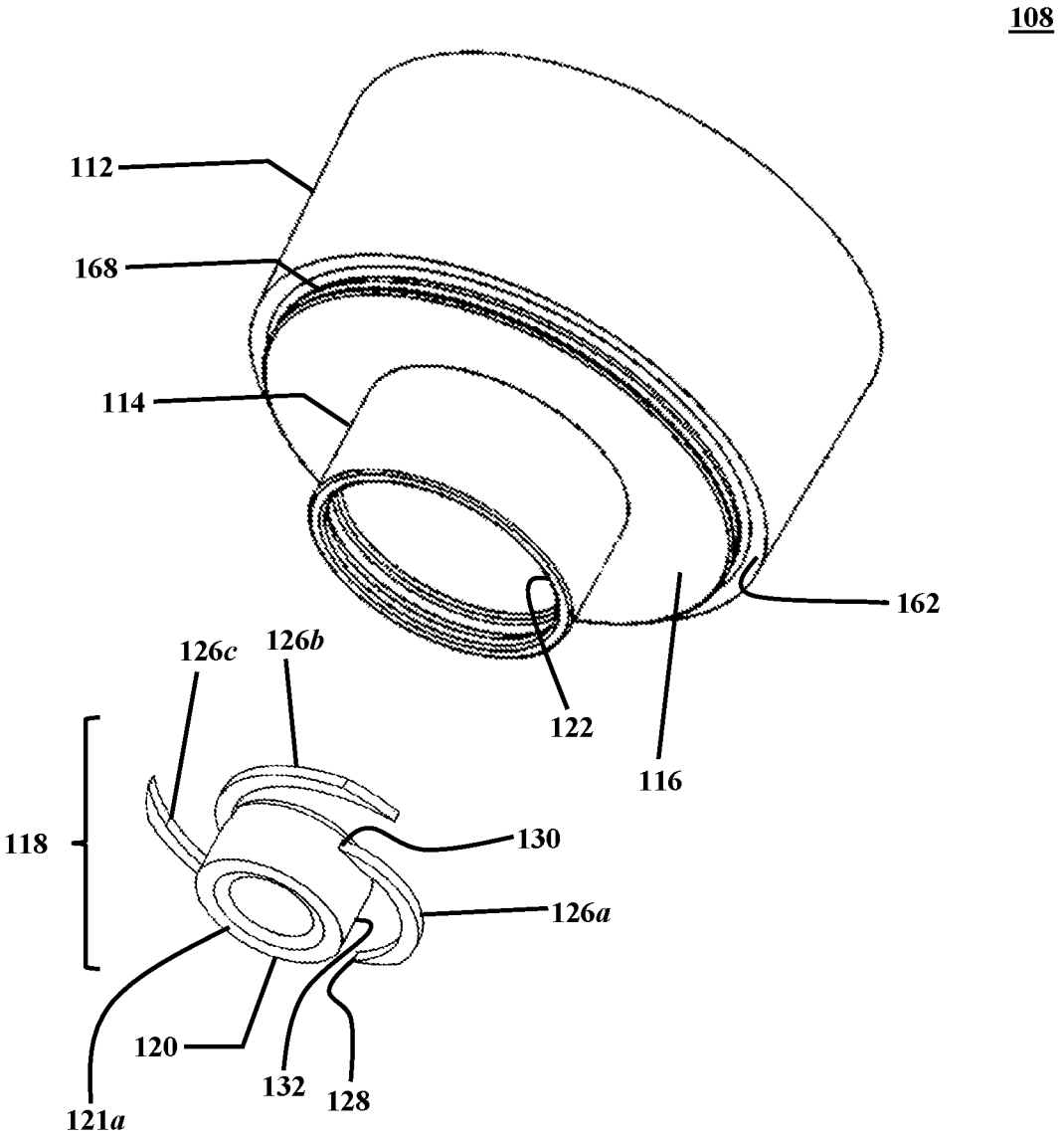
FIG. 3 illustrates an exploded perspective view of a threaded mounting section, consistent with one or more exemplary embodiments of the present disclosure.

FIG. 3 illustrates an exploded perspective view of threaded mounting section 108, consistent with one or more exemplary embodiments of the present disclosure. In an exemplary embodiment, annular threaded wall 112 and annular passage 114 may either be integrally formed as a single part or be attached to each other as two separate parts. In an exemplary embodiment, threaded mounting section 108 may further include a first spring-loaded plug 118 that may be mounted within threaded mounting section 108. In an exemplary embodiment, first spring-loaded plug 118 may be mounted inside annular passage 114.

In an exemplary embodiment, first spring-loaded plug 118 may include a first plug 120 that may be attached to an inner surface 122 of annular passage 114 utilizing a first resilient spiral spring 124. In an exemplary embodiment, first resilient spiral spring 124 may include a first plurality of resilient curved arms, such as resilient curved arms (126*a*, 126*b*, and 126*c*). In an exemplary embodiment, a first end of each resilient curved arm of the first plurality of resilient curved arms may be attached to inner surface 122 of annular passage 114 and a second end of each resilient curved arm of the first plurality of resilient curved arms may be attached to an outer surface 132 of first plug 120. For example, a first end 128 of resilient curved arm 126*a* may be attached to inner surface 122 of annular passage 114 and a second end 130 of resilient curved arm 126*a* may be attached to outer surface 132 of first plug 120.

In an exemplary embodiment, first plug 120 may include a cylindrical plug, where the base ends of the cylindrical plug may be parallel with base disk 116 and the cylindrical plug may be a cylinder elongated along normal axis 115. In an exemplary embodiment, first resilient spiral spring 124 may be compressible along normal axis 115 allowing a translational movement of first plug 120 along 115.

Figure 4:
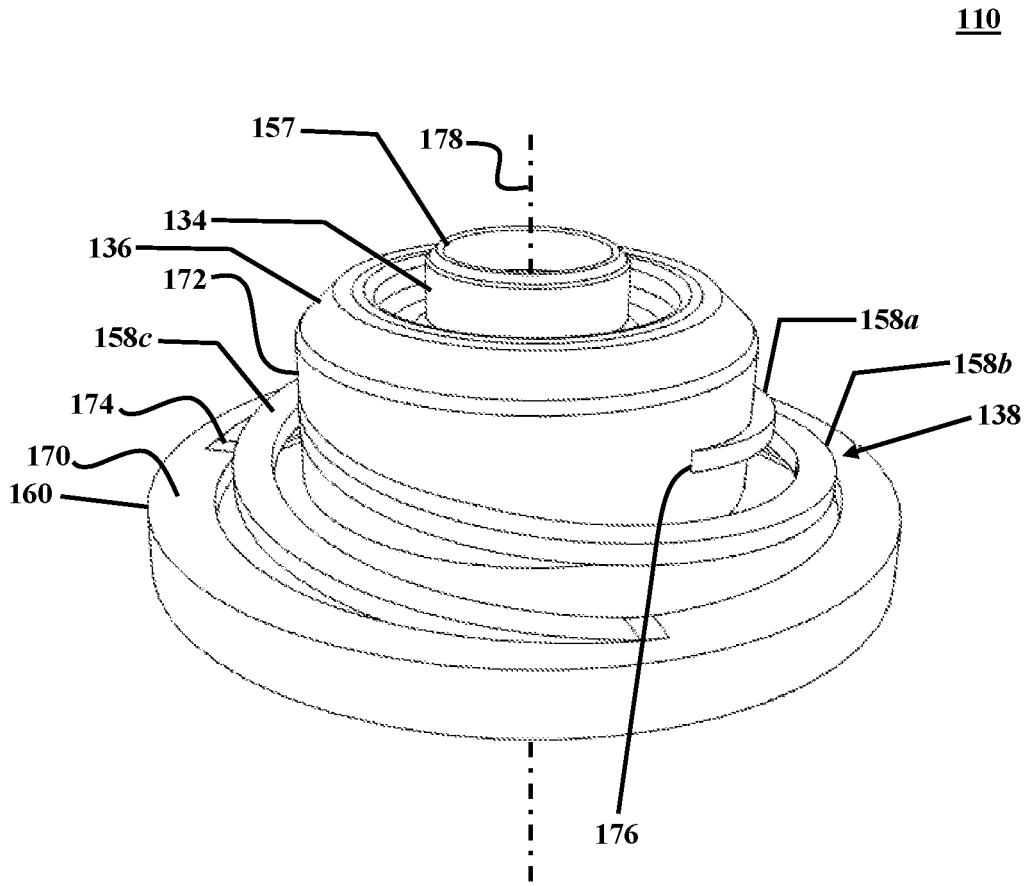
FIG. 4 illustrates a perspective view of a spring-loaded nozzle, consistent with one or more exemplary embodiments of the present disclosure.

FIG. 4 illustrates a perspective view of spring-loaded nozzle 110, consistent with one or more exemplary embodiments of the present disclosure. In an exemplary embodiment, spring-loaded nozzle 110 may include a nozzle 134 that may be housed within a housing 136 and a second resilient spiral spring 138 connected to housing 136. In an exemplary embodiment, housing 136 may include an annular base 140 with a central hole 142, a first upright annular wall 144 that may extend from an outer periphery of annular base 140 in the first direction shown by arrow 119*a*, and a second upright annular wall 146 that may extend from a top surface of annular base 140 in the first direction. In an exemplary embodiment, second upright annular wall 146 may be parallel with first upright annular wall 144. In an exemplary embodiment, second upright annular wall 146 may be positioned between first upright annular wall 144 and an outer periphery of central hole 142. In other words, second upright annular wall 146 may be encompassed by and parallel with first upright annular wall 144. In an exemplary embodiment, such configuration of first upright annular wall 144 and second upright annular wall 146 may allow for forming a slit 148 inside housing 136 between first upright annular wall 144 and second upright annular wall 146.

In an exemplary embodiment, nozzle 134 may either be a straight pipe/tube with a constant cross-sectional area (not illustrated) or a pipe/tube of varying cross sectional area. For example, nozzle 134 may include a divergent inlet port 150 and a convergent outlet port 152 connected to each other at a throat 154. In an exemplary embodiment, throat 154 may be positioned at central hole 142 and may lie flush with central hole 142. In an exemplary embodiment, nozzle 134 may pass through central hole 142 with a longitudinal axis 178 of nozzle 134 being parallel with a longitudinal axis of second upright annular wall 146. In an exemplary embodiment, nozzle 134 may be configured to control the direction and characteristics of the flow of viscous contents of squeeze bottle 102. In an exemplary embodiment, nozzle 134 may either be a pipe/tube extended beyond annular base 140 or alternately, central hole 142 may function as nozzle 134.

In an exemplary embodiment, inlet port 150 of nozzle 134 may include an annular edge 156 that may function as a seat, upon which, first plug 120 may be normally positioned. In an exemplary embodiment, first plug 120 may include a lower surface 121*a* and an upper surface 121*b*. In an exemplary embodiment, lower surface 121*a* of first plug 120 may be normally positioned on the seat provided by annular edge 156 of inlet port 150 of nozzle 134. In an exemplary embodiment, such configuration of first plug 120 and annular edge 156 of inlet port 150 may allow for forming a normally closed valve on inlet port 150 of nozzle 134. In an exemplary embodiment, first spiral spring 124 may be utilized to maintain the position of first plug 120 on annular edge 156 of inlet port 150. In other words, as used herein, first plug 120 being normally positioned on annular edge 156 of inlet port 150 may refer to a configuration or a physical placement that in the absence of external forces, lower surface 121*a* of first plug 120 may be positioned on annular edge 156 of inlet port 150 in a fluid-tight manner. In an exemplary embodiment, an external force may move first plug 120 away from the normal position of first plug 120 over annular edge 156 of inlet port 150, but when the external force is removed, first spiral spring 124 may restore the normal position of plug 120.

In an exemplary embodiment, spring-loaded nozzle 110 may further include an annular connecting ring 160 that may be configured to attach spring-loaded nozzle 110 to threaded mounting section 108. In an exemplary embodiment, base disk 116 may further include an annular recessed portion 162 that may function as a receptacle in which annular connecting ring 160 may be mounted. In an exemplary embodiment, annular connecting ring 160 may include an upward extended lip 164 that may be extended along the first direction (shown by arrow 119*a*). In an exemplary embodiment, upward extended lip 164 may include an annular bead 166 that may be push fit inside a corresponding slit 168 within annular recessed portion 162.

In an exemplary embodiment, second resilient spiral spring 138 may include a second plurality of resilient curved arms, such as resilient curved arms (158*a*, 158*b*, and 158*c*). In an exemplary embodiment, a resilient curved arm may refer to a curved arm that is able to absorb energy when it is deformed elastically, and release that energy upon uploading. In an exemplary embodiment, a first end of each resilient curved arm of the second plurality of resilient curved arms may be attached to a base end 170 of annular connecting ring 160 and a second end of each resilient curved arm of the second plurality of resilient curved arms may be attached to an outer surface 172 of housing 136. For example, a first end 174 of resilient curved arm 158*a* may be attached to base end 170 of annular connecting ring 160 and a second end 176 of resilient curved arm 158*a* may be attached to outer surface 172 of housing 136.

In an exemplary embodiment, second resilient spiral spring 138 may be compressible along longitudinal axis 178 of nozzle 134. In an exemplary embodiment, longitudinal axis 178 of nozzle 134 may be parallel with normal axis 115. In an exemplary embodiment, second resilient spiral spring 138 may be utilized to further maintain the position of annular edge 156 of inlet port 150 on lower surface 121*a* of plug 120. In an exemplary embodiment, when an external force, such as pressurized flow of viscous contents of squeeze bottle 102 through outlet port 103 is applied on nozzle 134, the external force may move nozzle 134 away from lower surface 121*a* of first plug 120 to allow the passage of viscous contents of squeeze bottle 102 through nozzle 134. In an exemplary embodiment, when the external force is removed, second resilient spiral spring 138 may restore the position of nozzle 134, such that annular edge 156 of inlet port 150 of nozzle 134 may be positioned on lower surface 121*a* of plug 120.

Figure 5:
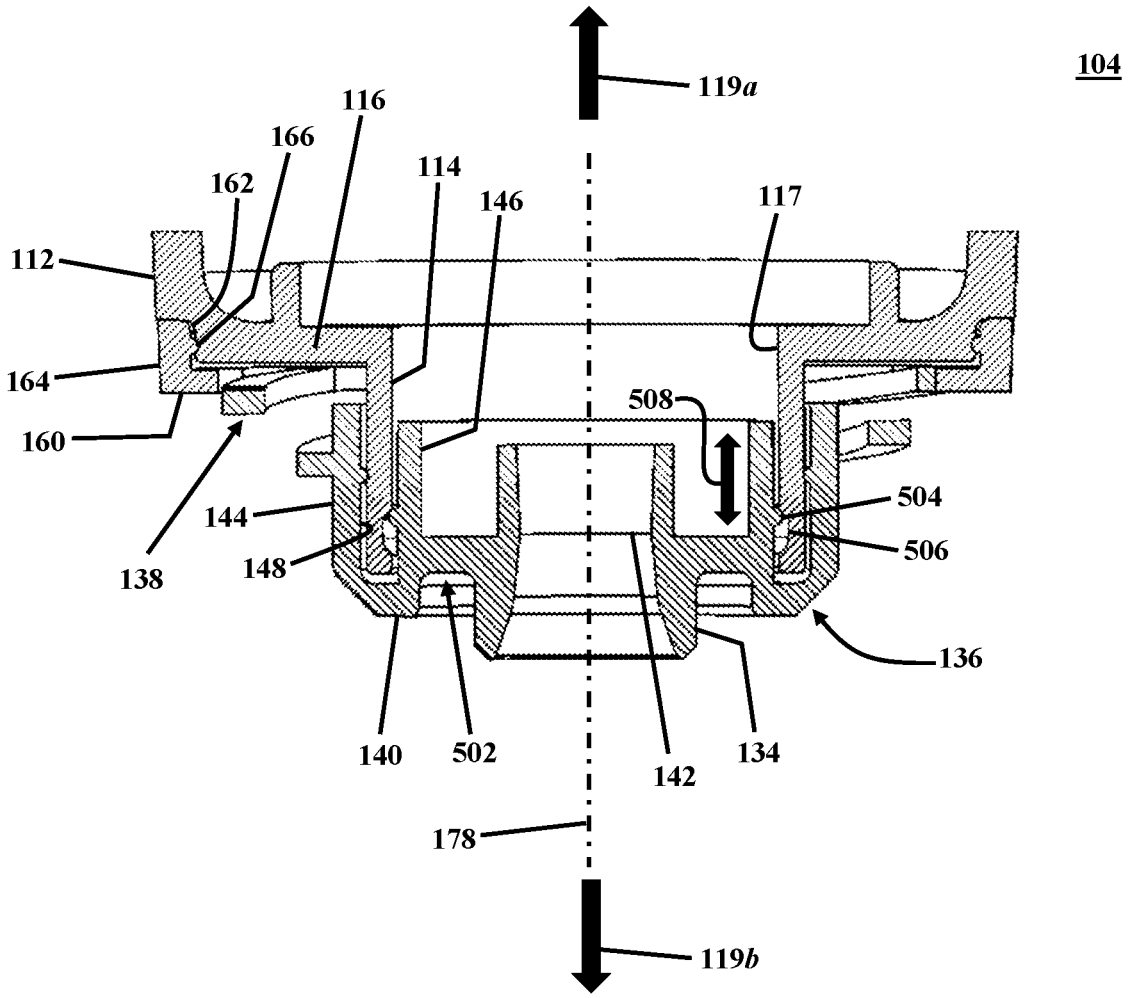
FIG. 5 illustrates a sectional side view of a dispensing assembly, consistent with one or more exemplary embodiments of the present disclosure.

FIG. 5 illustrates a sectional side view of dispensing assembly 104, consistent with one or more exemplary embodiments of the present disclosure. In an exemplary embodiment, annular passage 114 may further be slidably received within slit 148 between first upright annular wall 144 and second upright annular wall 146. In an exemplary embodiment, such slidable coupling of annular passage 114 and housing 154 may allow for housing 154 to move relative to annular passage 114 in response to either an external force pushing housing 154 away from threaded mounting section 108 along the second direction (shown by arrow 119*b*) or second resilient spiral spring 138 pulling housing 154 along the first direction (shown by arrow 119*a*) to restore the normal position of housing 154. In other words, such slidable coupling of annular passage 114 and housing 154 may allow for housing 154 to move relative to annular passage 114 up and down along a direction shown by arrow 508.

In an exemplary embodiment, the extent of relative sliding motion between annular passage 114 and housing 154 may be limited by utilizing an annular bead 504 on second upright annular wall 146 and a corresponding annular slit 506 on annular passage 114. In an exemplary embodiment, annular bead 504 may be disposed within annular slit 506 and may have a smaller cross-sectional area compared to annular slit 506. In an exemplary embodiment, annular bead 504 may be slidable within annular slit 506 along a direction shown by arrow 508. In an exemplary embodiment, the extent of sliding motion of annular bead 504 may be limited to a cross-sectional diameter of annular slit 506 along longitudinal axis 178. In an exemplary embodiment, physical placement of annular bead 504 and annular slit 506 or the fact that the extent of sliding motion of annular bead 504 is limited to a cross-sectional diameter of annular slit 506 along longitudinal axis 178 may allow for limiting the extent of relative sliding motion between annular passage 114 and housing 154.

In an exemplary embodiment, annular threaded wall 112 and base disk 116 may be integrally formed with annular recessed portion 162 on a lower annular edge of base disk 116. In an exemplary embodiment, nozzle 134, annular base 140, first upright annular wall 144, and second upright annular wall 146 may be integrally formed and annular base 140 may include an annular recessed portion 502 between second upright annular wall 146 and nozzle 134. In other words, in an exemplary embodiment, housing 136 and nozzle 134 may be integrally formed and may be attached to base disk 116 and annular threaded wall 112 utilizing second resilient spiral spring 138. In an exemplary embodiment, second resilient spiral spring 138 may further be integrally formed with housing 136 and nozzle 134.

Figure 6:
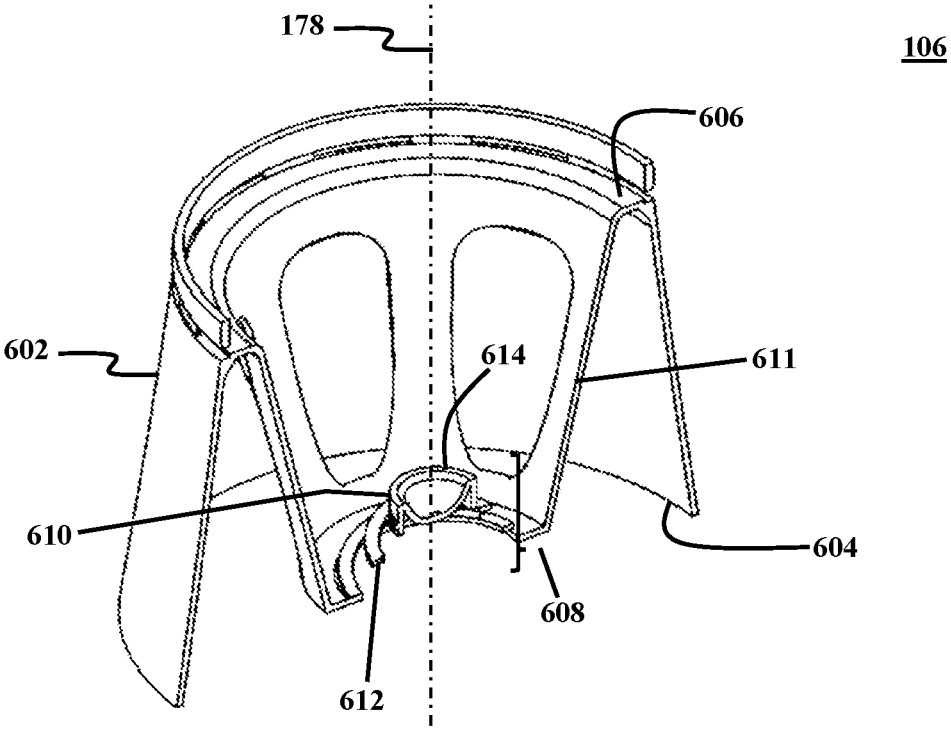
FIG. 6 illustrates a sectional perspective view of a base assembly, consistent with one or more exemplary embodiments of the present disclosure.

FIG. 6 illustrates a sectional perspective view of base assembly 106, consistent with one or more exemplary embodiments of the present disclosure. As mentioned before, in an exemplary embodiment, base assembly 106 may be configured to be coupled to dispensing assembly 104 to further prevent any possible leakage from dispensing assembly 104 and to facilitate an upside-down placement of squeeze bottle 102. In an exemplary embodiment, base assembly 106 may include a housing 602 generally extended along longitudinal axis 178 with an annular lower edge 604 that may provide a support base similar to base 107 for squeeze bottle 102 to rest upon. In an exemplary embodiment, housing 602 may be shaped like a frustum with annular lower edge 604 having a larger diameter compared to an annular upper edge 606 of housing 602. In an exemplary embodiment, such configuration of annular upper edge 606 and annular lower edge 604 of housing 602 may allow for a more stable placement of squeeze bottle 102 on base assembly 104, since a larger annular lower edge 604 may provide a more stable base for base assembly 104.

In an exemplary embodiment, base assembly 104 may further include a second spring-loaded plug 608 that may be attached to or integrally formed with housing 602 utilizing a mounting member 611 within and encompassed by housing 602. In an exemplary embodiment, second spring-loaded plug 608 may be coupled with housing 602 such that when base assembly 104 is attached to squeeze bottle 102, second spring-loaded plug 608 may be positioned immediately bellow spring-loaded nozzle 110. In an exemplary embodiment, second spring-loaded plug 608 may include a second plug 610 that may be attached to mounting member 611 utilizing a third resilient spiral spring 612. In an exemplary embodiment, second plug 610 may include a cylindrical plug, where the base ends of the cylindrical plug may be parallel with base disk 116 and the cylindrical plug may be a cylinder elongated along longitudinal axis 178. In an exemplary embodiment, third resilient spiral spring 612 may be compressible along longitudinal axis 178. In an exemplary embodiment, outlet port 152 of nozzle 134 may include an annular lower edge 157 that may rest upon an upper surface 614 of second plug 610, when base assembly 104 is attached to squeeze bottle 102. In an exemplary embodiment, such configuration of second plug 610 and annular lower edge 157 of outlet port 152 may allow for forming a normally closed valve on outlet port 152 of nozzle 134. In an exemplary embodiment, third spiral spring 612 may be utilized to maintain the position of second plug 610 on annular lower edge 157 of outlet port 152.

Figure 7:
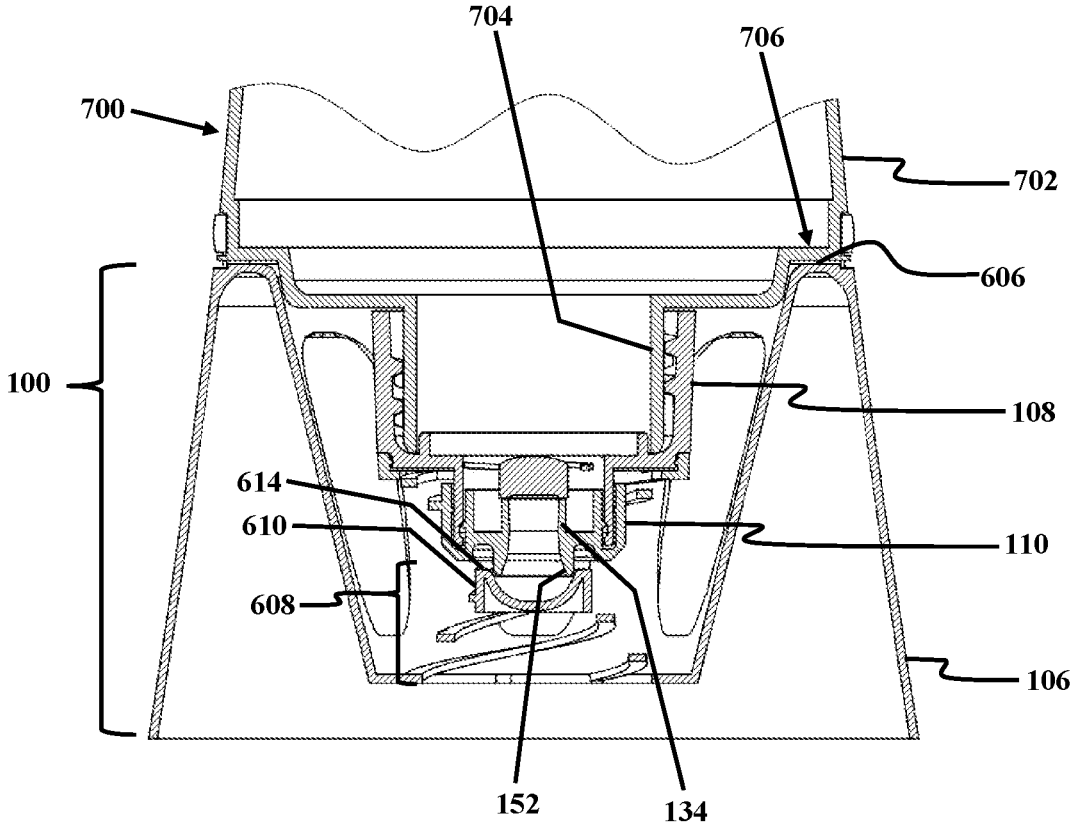
FIG. 7 illustrates a sectional front view of a leak-free cap mounted on a squeeze bottle, consistent with one or more exemplary embodiments of the present disclosure.

FIG. 7 illustrates a sectional front view of leak-free cap 100 mounted on a squeeze bottle 700, consistent with one or more exemplary embodiments of the present disclosure. In an exemplary embodiment, squeeze bottle 700 may be similar in structure and functionality to squeeze bottle 102. In an exemplary embodiment, squeeze bottle 700 may include a main body 702 and an outlet port 704 that may be similar in structure and functionality to outlet port 103 on which threaded mounting section 108 may be screwed. In an exemplary embodiment, squeeze bottle 700 may further include an annular shoulder 706 between main body 702 and outlet port 704. In an exemplary embodiment, base assembly 106 may be coupled with squeeze bottle 700, such that shoulder 706 may be mounted on annular upper edge 606 of base assembly 106. For example, annular upper edge 606 of base assembly 106 may be push fit on shoulder 706.

In an exemplary embodiment, responsive to base assembly 106 being attached to squeeze bottle 700 as was described in the above paragraph, upper surface 614 of second plug 610 may be positioned immediately below nozzle 134, such that upper surface 614 may encompass a lower edge of convergent outlet port 152 of nozzle 134. Such configuration of second plug 610 and nozzle 134 may further allow for prevention of any possible leak from nozzle 134.

Figure 8A:
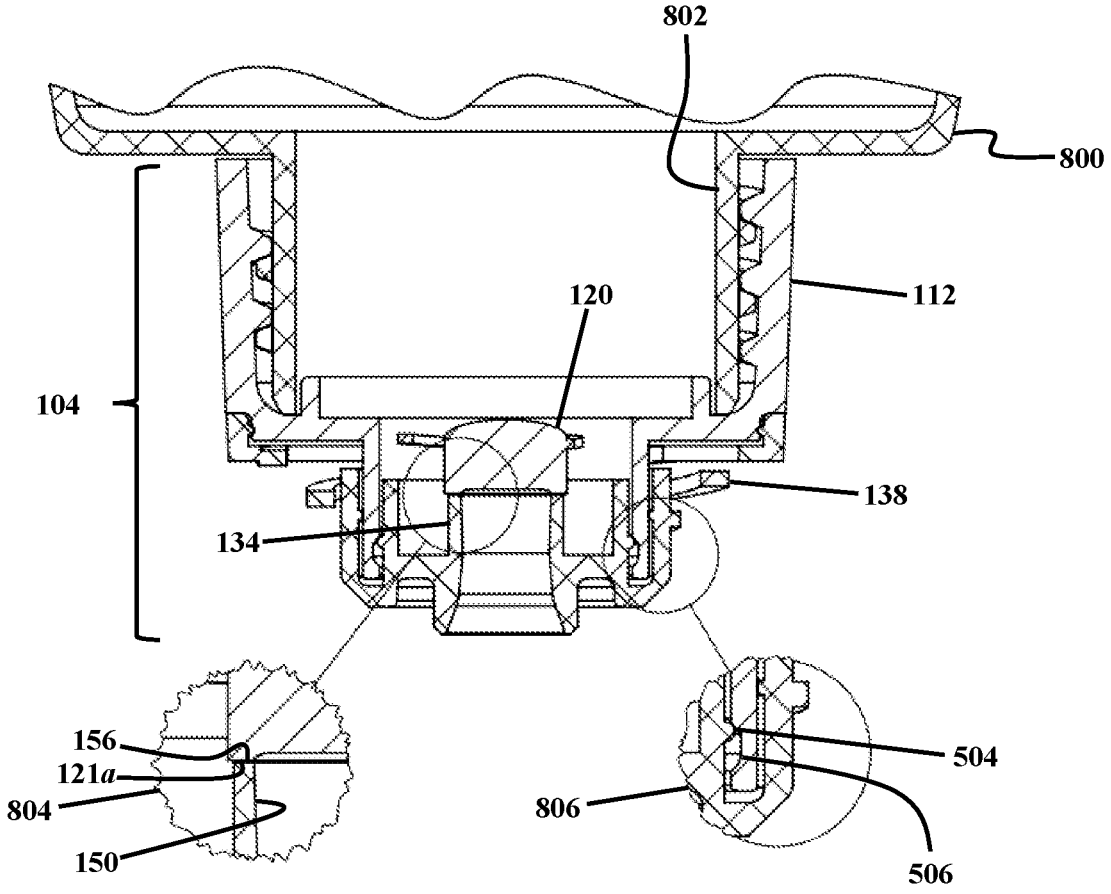
FIG. 8A illustrates a sectional front view of a dispensing assembly mounted on a squeeze bottle in a closed state, consistent with one or more exemplary embodiments of the present disclosure.
Figure 8B:
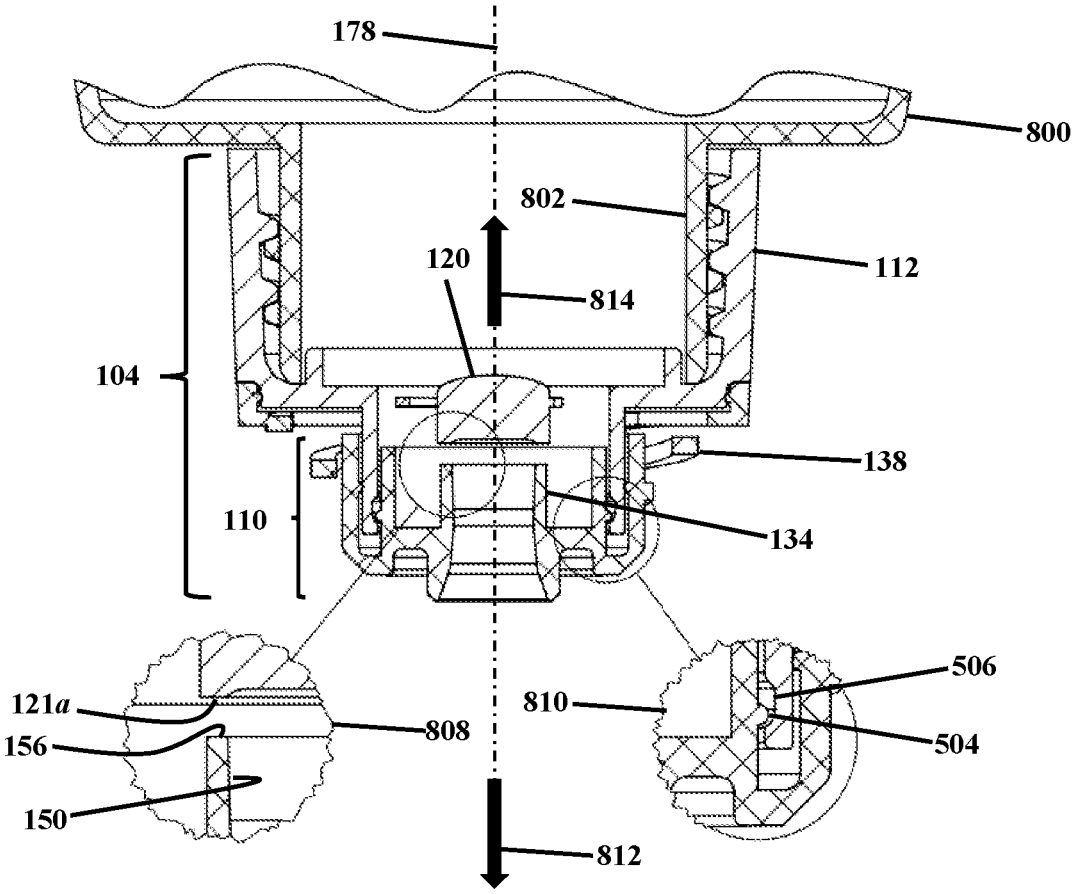
FIG. 8B illustrates a sectional front view of a dispensing assembly mounted on a squeeze bottle in an open discharging state, consistent with one or more exemplary embodiments of the present disclosure.
Figure 8C:
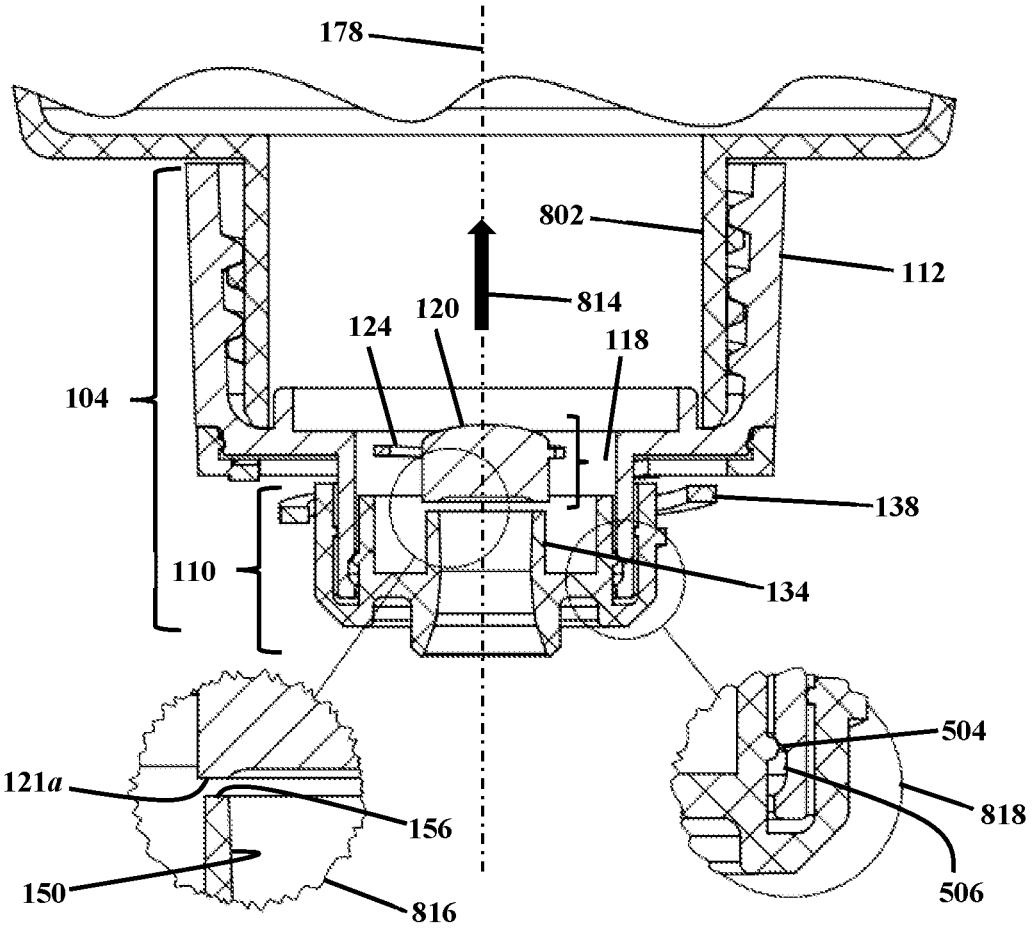
FIG. 8C illustrates a sectional front view of a dispensing assembly mounted on a squeeze bottle in a repressurizing state, consistent with one or more exemplary embodiments of the present disclosure.

FIG. 8A illustrates a sectional front view of dispensing assembly 104 mounted on a squeeze bottle 800 in a closed state, consistent with one or more exemplary embodiments of the present disclosure. FIG. 8B illustrates a sectional front view of dispensing assembly 104 mounted on squeeze bottle 800 in an open discharging state, consistent with one or more exemplary embodiments of the present disclosure. FIG. 8C illustrates a sectional front view of dispensing assembly 104 mounted on squeeze bottle 800 in a repressurizing state, consistent with one or more exemplary embodiments of the present disclosure. In an exemplary embodiment, squeeze bottle 800 may be similar to squeeze bottle 102 and 700.

Referring to FIG. 8A, in an exemplary embodiment, dispensing assembly 104 may be removably attached to an outlet port 802 of squeeze bottle 800 by screwing annular threaded wall 112 on outlet port 802, which may also be an externally threaded port. In an exemplary embodiment, an externally threaded port may refer to a port that includes a threaded section on an outer surface of the port. In an exemplary embodiment, when squeeze bottle 800 is not in use and is placed or stored upside-down, dispensing assembly 104 may be configured to close outlet port 802 of squeeze bottle 800, such that no liquid from squeeze bottle 800 may pass through dispensing assembly 104. In an exemplary embodiment, inset 804 illustrates how annular upper edge 156 of inlet port 150 of nozzle 134 may tightly contact lower surface 121*a* of first plug 120. As used herein, annular upper edge 156 tightly contacting lower surface 121*a* may refer to a situation where no liquid may pass between annular upper edge 156 and lower surface 121*a*. In other words, annular upper edge 156 and lower surface 121*a* may cooperate to form a liquid-tight seal on outlet port 802.

As discussed earlier, second resilient spiral spring 138 may maintain the position of nozzle 134 below first plug 120 such that annular upper edge 156 of inlet port 150 of nozzle 134 may tightly contact lower surface 121*a* of first plug 120. In other words, nozzle 134 may be spring-loaded utilizing second resilient spiral spring 138, which may restore the position of nozzle 134 by exerting upward force on nozzle 134 towards outlet port 802 of squeeze bottle 800. As shown in inset 806, in an exemplary embodiment, responsive to annular upper edge 156 of nozzle 134 being in contact with lower surface 121*a* of first plug 120, annular bead 504 may contact an upper extremity of annular slit 506 along longitudinal axis 178.

Referring to FIG. 8B, in an exemplary embodiment, when a user picks up squeeze bottle 800 and squeezes squeeze bottle 800 to dispense the contents of squeeze bottle 800, the contents of squeeze bottle 800 may push down spring-loaded nozzle 110 away from outlet port 802 along longitudinal axis 178. In an exemplary embodiment, such downward force exerted by the contents of squeeze bottle 800 on spring-loaded nozzle 110 may force nozzle 134 downward along longitudinal axis 178. In an exemplary embodiment, as illustrated in inset 808, such downward movement of nozzle 134 may cause upper annular edge 156 of inlet port 150 of nozzle 134 to be pushed away from lower surface 121*a* of first plug 120, thereby allowing the contents to flow through nozzle 134 and be dispensed out of squeeze bottle 800.

In an exemplary embodiment, in response to nozzle 134 being pushed downward under the external force exerted by the contents of squeeze bottle 800, second resilient spiral spring 138 may resiliently extend downward along longitudinal axis 178. As used herein, downward may refer to a direction 812 along longitudinal axis 178 away from outlet port 802 of squeeze bottle 800 and upward may be the opposite direction of downward and may further refer to a direction 814 longitudinal axis 178 toward an interior of squeeze bottle 800. As shown in inset 810, in an exemplary embodiment, responsive to annular upper edge 156 of nozzle 134 moving away from lower surface 121*a* of first plug 120, annular bead 504 may contact a lower extremity of annular slit 506 along longitudinal axis 178. In an exemplary embodiment, as discussed before, such contact of annular bead 504 with the lower extremity of annular slit 506 along longitudinal axis 178 may limit translational movement of nozzle 134 along direction 812.

Referring to FIG. 8C, in an exemplary embodiment, when a user stops squeezing squeeze bottle 800, squeeze bottle 800 may deform back to the original unsqueezed form of squeeze bottle 800. Here, second resilient spiral spring 136 may restore nozzle 134 back to the initial position or normal position of nozzle 134 (illustrated in FIG. 8A), however, as air is sucked into squeeze bottle 800 responsive to squeeze bottle 800 deforming back to the unsqueezed form of squeeze bottle 800, first plug 120 may be pushed upward by the flow of air. In an exemplary embodiment, such upward movement of first plug 120 may be possible by compression of first resilient spiral spring 124 along direction 814. In an exemplary embodiment, as illustrated in inset 818, in an exemplary embodiment, responsive to nozzle 134 being restored to the initial position of nozzle 134, annular bead 504 may again contact upper extremity of annular slit 506 along longitudinal axis 178. In an exemplary embodiment, as illustrated in inset 816, due to upward movement of first plug 120 away from inlet port 150 of nozzle 134, a gap may be created between lower surface 121*a* of first plug 120 and upper annular edge 156 of inlet port 150 of nozzle 134 that may allow air to be sucked into squeeze bottle 800. After the air has entered squeeze bottle 800, first resilient spiral spring 124 may urge first plug 120 to return to the normal position of first plug 120 (illustrated in FIG. 8A).

In exemplary embodiments, such configuration of spring-loaded nozzle 110 and first spring-loaded plug 118 may allow for an easy dispensing of the liquid contents of squeeze bottle 800 when squeeze bottle 800 is squeezed and an easy restoration of squeeze bottle 800 to its original form, when the squeezing pressure is removed from squeeze bottle 800.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for description and not of limitation, such that the terminology or phraseology of the present specification is to be interpreted by the skilled artisan in light of the teachings and guidance.

The breadth and scope of the present disclosure should not be limited by any of the above-described exemplary embodiments but should be defined only in accordance with the following claims and their equivalents.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps. Moreover, the word "substantially" when used with an adjective or adverb is intended to enhance the scope of the particular characteristic, e.g., substantially planar is intended to mean planar, nearly planar and/or exhibiting characteristics associated with a planar element. Further use of relative terms such as "vertical", "horizontal", "up", "down", and "side-to-side" are used in a relative sense to the normal orientation of the apparatus.

What is claimed is:

1. A bottle cap for a squeeze bottle, comprising:

a threaded mounting section extending between a first end of the threaded mounting section and a second opposing end of the threaded mounting section, the threaded mounting section configured to be screwed to an outlet port of the squeeze bottle from the first end of the threaded mounting section, the threaded mounting section comprising:

a first annular base disk with a first central hole;

an annular threaded wall extending from an outer periphery of the first annular base disk in a first direction along a normal axis of the first annular base disk, the annular threaded wall configured to be screwed to the outlet port of the squeeze bottle; and an annular passage extending from a periphery of the first central hole in a second direction along the normal axis of the first annular base disk, the second direction opposite the first direction;

a spring-loaded nozzle attached to the second end of the threaded mounting section, the spring-loaded nozzle comprising a nozzle and a first resilient spiral spring, the nozzle extending between an inlet port of the nozzle and an outlet port of the nozzle, the first resilient spiral spring configured to connect the second end of the threaded mounting section to an outer surface of the nozzle; and a first spring-loaded plug mounted within the threaded mounting section between the opening of the squeeze bottle and the inlet port of the nozzle, the first spring-loaded plug comprising a first plug attached to an inner surface of the threaded mounting section utilizing a second resilient spiral spring, the first plug configured to sit on a peripheral ledge of the inlet port of the nozzle, wherein the second resilient spiral spring is attached to an inner surface of the annular passage from a first end of the second resilient spiral spring, the second resilient spiral spring attached to an outer surface of the first plug from second opposing end of the second resilient spiral spring.

2. The bottle cap of claim 1, wherein the first plug comprises a cylindrical plug, the cylindrical plug comprising a main body extending between two base ends, the main body extending along the longitudinal axis of the nozzle, the base ends parallel with the first annular base disk.

3. The bottle cap of claim 2, wherein the first plug further configured to sit on the peripheral ledge of the inlet port of the nozzle from a top surface of a base end of the two base ends.

4. The bottle cap of claim 1, wherein the threaded mounting section further comprises an annular recessed portion on an outer periphery of the first annular base disk, the spring-loaded nozzle further comprising an annular ring with an extended annular lip, the extended annular lip configured to be mounted within the annular recessed portion.

5. The bottle cap of claim 4, wherein the spring-loaded nozzle further comprises an annular housing, the annular housing coaxially mounted around the nozzle, the annular housing comprising:

a second annular base disk with a second central hole;

a first upright annular wall extending from an outer periphery of the second annular base in the first direction; and a second upright annular wall extending from a top surface of the second annular base disk in the first direction, the second upright annular wall parallel with the first upright annular wall, the second upright annular wall positioned between the first upright annular wall and an outer periphery of the second central hole, the second upright annular wall encompassed by and parallel with the first upright annular wall, wherein, the nozzle is fitted within the second central hole with a longitudinal axis of the nozzle parallel with a longitudinal axis of the second upright annular wall.

6. The bottle cap of claim 5, wherein the annular passage is configured to be positioned within an annular slit formed between the first upright annular wall and the second upright annular wall, the annular passage slidable within the annular slit.

7. The bottle cap of claim 6, wherein the annular passage slidable within the annular slit along the longitudinal axis of the nozzle.

8. The bottle cap of claim 6, wherein the annular passage further comprises an annular recessed ring at a lower portion of the annular passage, the first upright annular wall further comprising an annular protruding lip, the protruding lip disposed and slidable within the annular recessed ring.

9. The bottle cap of claim 6, wherein the first resilient spiral spring comprises a first plurality of resilient curved arms, a first end of each resilient curved arm of the first plurality of resilient curved arms attached to the annular ring and a second end of each resilient curved arm of the first plurality of resilient curved arms attached to an outer surface of the first upright annular wall.

10. The bottle cap of claim 9, wherein the second resilient spiral spring comprises a second plurality of resilient curved arms, a first end of each resilient curved arm of the second plurality of resilient curved arms attached to the inner surface of the annular passage and a second end of each resilient curved arm of the second plurality of resilient curved arms attached to the outer surface of the first plug.

11. The bottle cap of claim 10, wherein:

the inlet port of the nozzle comprises a divergent tube, the outlet port of the nozzle comprises a convergent tube, and the inlet port connected to the outlet port at a throat, the throat configured to lie flush with the second central hole of the second annular base disk.

12. The bottle cap of claim 11, further comprising a base assembly, the base assembly comprising:

a base housing extending along the longitudinal axis of the nozzle, the base housing comprising a frustum with an upper annular edge and a lower annular edge, the upper annular edge configured to support the squeeze bottle; and a second spring-loaded plug comprising a second plug attached to an inner surface of the base housing utilizing a third resilient spiral spring, the second plug configured to sit on a peripheral ledge of the outlet port of the nozzle.

13. The bottle cap of claim 12, wherein the second plug comprises a cylindrical plug, the cylindrical plug comprising a main body extending between two base ends, the main body extending along the longitudinal axis of the nozzle, the base ends parallel with the first annular base disk.

14. The bottle cap of claim 2, wherein the second plug further configured to sit on the peripheral ledge of the outlet port of the nozzle from a top surface of a base end of the two base ends.

* * * * *